US005785882A

United States Patent [19]

Yamamoto et al.

[11] Patent Number: 5,785,882

[45] Date of Patent: Jul. 28, 1998

[54] FLUORINE-BASED MAGNETIC FLUID

[75] Inventors: Yasushi Yamamoto, Tsukuba; Yoshiyuki Takeishi, Tsuchiura; Yutaka Kouda; Tomoko Minagawa, both of Tsukuba; Takao Kanno, Tokyo, all of Japan

[73] Assignee: NOK Corporation, Tokyo, Japan

[21] Appl. No.: 901,359

[22] Filed: Jul. 28, 1997

[30] Foreign Application Priority Data

| | | | |
|---|---|---|---|
| Jul. 31, 1996 | [JP] | Japan | 8-217985 |
| Aug. 23, 1996 | [JP] | Japan | 8-241029 |
| Sep. 26, 1996 | [JP] | Japan | 8-273971 |

[51] Int. Cl.[6] ..... H01F 1/44

[52] U.S. Cl. ..... 252/62.52; 252/62.54

[58] Field of Search ..... 252/62.52, 62.54

[56] References Cited

U.S. PATENT DOCUMENTS

| | | | |
|---|---|---|---|
| 3,784,471 | 1/1974 | Kaiser | 252/21 |
| 5,718,833 | 2/1998 | Yamamoto et al. | 252/62.52 |

OTHER PUBLICATIONS

Abstract for JP 9–289110, Nov. 4, 1997.

Abstract for JP 09–260128, Oct. 3, 1997.

Abstract for JP 63–131502, Jun. 3, 1988.

*Primary Examiner*—Melissa Bonner

*Attorney, Agent, or Firm*—Barnes & Thornburg

[57] ABSTRACT

A fluorine-based magnetic fluid, which comprises (A) fine magnetic particles as dispersed in (D) a perfluoropolyether base oil represented by the following general formula:

$$F[CF(CF_3)CF_2O]mRf$$

where Rf is a perfluoroalkyl group by means of general formulae:

$$(B_1)\{F[CF(CF_3)CF_2O]nCF(CF_2)(Y)v(R)wO\}tPO(OM)u,$$

$$(B_2)F[CF(CF_3)CF_2O]nCF(CF_3)YRSO_2M$$

or $$(B_3)F[CF(CF_3)CF_2O]nCF(CF_3)X(RO)sCH_2COOM$$

where R is a divalent organic group; Y is a COO group or CONH group; X is a COO group or $CH_2O$ group; and M is a hydrogen group, an alkali metal, an alkaline earth metal or an ammonium group and perfluoroether carboxylic acid amide compounds represented by the following general formulae:

$$(C_1)F[CF(CF_3)CF_2O]pCF(CF_3)CONH(CH_2)qNH_2,$$

$$(C_2)F[CF(CF_3)CF_2O]pCF(CF_3)CONH(CH_2CH_2NH)rH$$

or $$(C_3)F[CF(CF_3)CF_2O]pCF(CF_3)CONH(CH_2CH_2NH)rCOCF(CF_3)[OCF_2CF(CF_2)]pF$$

has an increased affinity of the fine magnetic particles toward the perfluoropolyether base oil and is effectively used as a sealing material for vacuum apparatus.

36 Claims, No Drawings

FLUORINE-BASED MAGNETIC FLUID

BACKGROUND OF THE INVENTION

1. Field of the Invention

The present invention relates to a fluorine-based magnetic fluid, and more particularly to a fluorine-based magnetic fluid comprising fine magnetic particles as dispersed in a perfluoropolyether base oil.

2. Description of Related Art

U.S. Pat. No. 3,784,471 discloses a fluorine-based magnetic fluid comprising surfactant-adsorbed, fine ferrite particles as dispersed in a perfluoropolyether base oil, where perfluoropolyether carboxylic acid represented by the following general formula:

$$F[CF(CF_3)CF_2O]mCF(CF_3)COOH$$

where m is an integer of 3 to 50, or its ammonium salt, etc. is used as the surfactant adsorbed on fine ferrite particles.

However, mere dispersion of such perfluoropolyether carboxylic acid surfactant-adsorbed, fine ferrite particles in the perfluoropolyether base oil has a poor dispersibility and a considerably large amount of poorly dispersed fine particles in the base oil, resulting in a considerable decrease not only in the magnetic fluid yield, but also in saturation magnetization of the resulting magnetic fluids, that is, poor practical applicability. Furthermore, the above-mentioned U.S. Patent discloses that the dispersibility is poor when the m value of the perfluoropolyether carboxylic acid or its salts is smaller.

SUMMARY OF THE INVENTION

An object of the present invention is to provide a fluorine-based magnetic fluid having a higher affinity of fine magnetic particles toward a perfluoropolyether base oil and an effective application as a sealing material for vacuum apparatus, etc.

According to the present invention, there is provided a fluorine-based magnetic fluid, which comprises (A) fine magnetic particles as dispersed in (D) a perfluoropolyether base oil by means of at least one of ($B_1$) a perfluoroether phosphoric acid or its salt represented by the following general formula:

$$\{F[CF(CF_3)CF_2O]nCF(CF_3)(Y)v(R)wO\}tPO(OM)u$$

where R is a divalent organic group, Y is a COO group or CONH group, M is a hydrogen atom, an alkali metal, an alkaline earth metal or an ammonium group, t is an integer of 1 to 100, n is 1 or 2, u is 3-t and v and w are 0 or 1;

($B_2$) a perfluoroether sulfonic acid, a perfluoroether sulfuric acid ester or their salt, represented by the following general formula:

$$F[CF(CF_3)CF_2O]nCF(CF_3)YRSO_3M$$

or by the following general formula:

$$F[CF(CF_3)CF_2O]nCF(CF_3)(Y)mR'OSO_3M$$

where R and R' each are a divalent organic group, M is a hydrogen atom, an alkali metal, an alkaline earth metal or an ammonium group, Y is a COO group or CONH group, n is an integer of 1 to 100 and m is 0 or 1; and ($B_3$) a perfluoroether (poly)alkyleneether carboxylic acid or its salt represented by the following general formula:

$$F[CF(CF_3)CF_2O]nCF(CF_3)X(RO)sCH_2COOM$$

where R is a lower alkylene group, M is a hydrogen atom, an alkali metal, alkaline earth metal or an ammonium group, X is a COO group or $CH_2O$ group, and n and s each are an integer of 1 to 100; and (C) at least one of a perfluoroether carboxylic acid amide compound represented by the following general formula:

$$F[CF(CF_3)CF_2O]pCF(CF_3)CONH(CH_2)qNH_2,$$

$$F[CF(CF_3)CF_2O]pCF(CF_3)CONH(CH_2CH_2NH)rH$$

and $$F[CF(CF_3)CF_2O]pCF(CF_3)CONH(CH_2CH_2NH)rCOCF(CF_3)[OCF_2CF(CF_3)]pF$$

where p is an integer of at least 1, preferably 40 to 50, q is an integer of 2 to 20 and r is an integer of 1 to 6.

DETAILED DESCRIPTION OF THE INVENTION

Fine magnetic particles for use in the present invention are generally fine ferrite particles, prepared by any appropriate methods, preferably by a coprecipitation method having advantages of controlling their purity and particle size, particularly their productivity. The preferable fine ferrite particles prepared by the coprecipitation method include, for example, fine particles of magnetite ($Fe_3O_4$), nickel ferrite ($NiO.Fe_2O_3$), manganese ferrite ($MnO.Fe_2O_3$), cobalt ferrite ($CoO.Fe_2O_3$), nickel-zinc ferrite ($Ni.ZnO.Fe_2O_3$), manganese-zinc ferrite ($Mn.ZnO.Fe_2O_3$), cobalt-zinc ferrite ($Co.ZnO.Fe_2O_3$), etc.

Besides, fine particles of such a metal as iron, manganese, nickel, cobalt, etc. or their borides, nitrides, carbides, etc. or furthermore fine particles of alloys of these metals with at least one of such other metals as magnesium, alminum, zinc, copper, niobium, molybdenum, gallium, indium, zirconium, cadmium, tin, etc. or their borides, nitrides, carbides, etc. can be also used as fine magnetic particles.

Generally, fine magnetic particles have a high hydrophilic property and accordingly undergo coagulation as such in a base oil, resulting in a failure to form a magnetic fluid. Thus, it is necessary to make the surfaces of fine magnetic particles have a higher affinity toward a base oil, thereby preventing their coagulation. Compounds for use to enhance the affinity toward a base oil and prevent the coagulation must have preferably a fluorophilic group and a polar group having a strong adsorbability to ferrites in one molecule at the same time. In view of the necessity for a long chain having some elasticity to prevent coagulation of fine particles and a good solubility or dispersibility in a solvent, compounds having a perfluoroether group as a fluorophilic group are selected.

Accordingly, from the viewpoint of these observations, at least one of perfluoroether phosphoric acid or its salt represented by the foregoing general formula ($B_1$); perfluoroether sulfonic acid, perfluoroether sulfuric acid ester or their salts represented by the foregoing general formulae ($B_2$); and perfluoroether (poly)alkyleneether carboxylic acid or its salt represented by the foregoing general formula ($B_3$) is used in the present invention.

Perfluoroether phosphoric acid or its salt ($B_1$) can be prepared from hexafluoropropene oxide oligomers having a repetition unit n of 1 to 100, preferably 4 to 20, by a known method for phosphoric acid ester synthesis. Not only mono- or di-ester alone, but also readily available ester mixtures perse can be used. For the R group as a divalent organic aroup, alkylene groups having 1 to 20 carbon atoms, arylene groups, etc. can be used. The upper limit of the repetition unit n to 100 is selected on the basis of such observations that when n exceeds 100, the characteristics (viscosity, etc.) of a magnetic fluid so prepared are deteriorated.

Perfluoroether sulfonic acid or its salts ($B_2$) can be readily prepared by a method as will be described below. For the R group as a divalent organic group, alkylene groups having 1 to 20 carbon atoms, arylene groups, etc. can be used. For the R' group, similar alkylene groups, polyalkyleneether groups, arylene groups, etc. can be used.

Perfluoroether sulfonic acid or its salt represented by the following general formula:

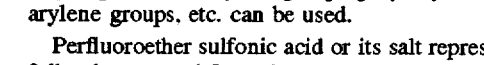

$$F[CF(CF_3)CF_2O]nCF(CF_3)YRSO_3M$$

can be prepared by reaction of carboxylic acid or its derivative derived from hexafluoropropene oxide oligomers having a repetition unit n of 1 to 100 as an integer with aminoalkylsulfonic acid or its salt, or with hydroxyalkylsulfonic acid or its salt.

Perfluoroether sulfuric acid ester or its salt represented by the following general formula:

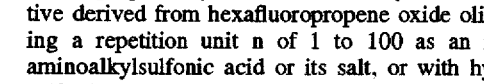

$$F[CF(CF_3)CF_2O]nCF(CF_3)\ (Y)mR'OSO_3M$$

can be prepared by subjecting condensates of carboxilic acid or its derivative derived from hexafluoropropene oxide oligomers having a repetition unit n of at least 1 as an integer with diol or aminoalcohol, or an alcohol reduction product of carboxylic acid or its derivative derived from hexafluoropropene oxide oligomers to esterification with sulfuric acid.

Limitation of the n value to the above-mentioned range in the general formulae for these two perfluoroether sulfonic acid and perfluoroether sulfuric acid ester or their salts are based on such observation that, when n is outside the range, deterioration of characteristics such as a decrease in the dispersibility, an increase in the viscosity, etc. of the resulting magnetic fluid occurs.

Perfluoroether (poly)alkyleneether carboxylic acid or its salt ($B_3$) can be readily prepared by the following two-stage synthesis method:

I. Synthesis of perfluoroether (poly)alkyleneether:

(1) In case of X being a COO group, perfluoroether (poly)alkyleneether represented by the following general formula:

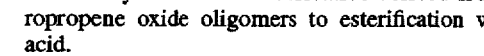

$$F[CF(CF_3)CF_2O]nCF(CF_3)COO(RO)sH$$

can be synthesized by esterification through dehydrofluorination between an acid fluoride represented by the following general formula derived from hexafluoropropene oxide oligomers having a repetition unit n of at least 1, preferably about 4 to about 50:

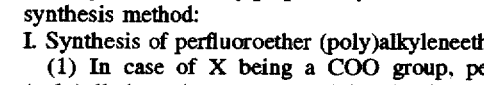

$$F[CF(CF_3)CF_2O]nCF(CF_3)COF$$

and (poly)alkyleneglycol represented by the following general formula, which has a repetition units of 1 to 100, preferably 1 to 30:

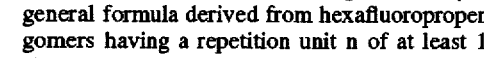

$$HO(RO)sH$$

particularly preferably polyethyleneglycol or polypropyleneglycol, or by transesterification between alkyl ester of carboxylic acid derived from the hexafluoropropene oxide oligomers and the (poly)alkyleneglycol.

(2) In case of X being a $CH_2O$ group, perfluoroether (poly)alkyleneether represented by the following general formula:

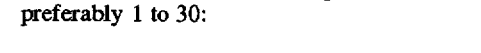

$$F[CF(CF_3)CF_2O]nCF(CF_3)CH_2O(RO)sH$$

can be synthesized by esterification of an alcohol represented by the following general formula, which is obtained by reduction of carboxylic acid derived from the hexafluoropropene oxide oligomer by a reducing agent such as $LiAlH_4$, $NABH_4$, etc.

$$F[CF(CF_3)CF_2O]_nCF(CF_3)CH_2OH$$

and the (poly)alkyleneglycol, using a dehydration catalyst such as sulfuric acid, etc.

II. Synthesis of perfluoroether (poly)alkyleneether carboxylic acid or its salt:

Perfluoroether (poly)alkyleneethers obtained by the foregoing method I are subjected to action with sodium monochloroacetate $ClCH_2COONa$ and alkali hydroxide, whereby sodium carboxylates having the following formulae can be obtained correspondingly:

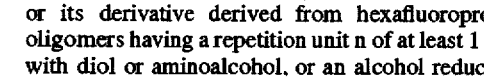

$$F[CF(CF_3)CF_2O]nCF(CF_3)COO(RO)sCH_2COONa$$

$$F[CF(CF_3)CF_2O]nCF(CF_3)CH_2O(RO)sCH_2COONa$$

These sodium salts can be converted to free carboxylic acids by acidification with mineral acids such as hydrochloric acid, sulfuric acid, etc. and the free carboxylic acids can be further changed to other cation species by neutralization with other alkali metals, alkaline earth metals or ammonia.

Furthermore, perfluoroether carboxylic acid amide compounds can be readily synthesized by dehydrofluorination of an acid fluoride of carboxylic acid derived from hexafluoropropene oxide oligomer and α,ω-diaminoalkane $NH_2(CH_2)qNH_2$ or polyamine $NH_2(CH_2CH_2NH)rH$, or by substation reaction to allow an alkyl ester of carboxylic acid derived from hexafluoropropene oxide oligomer to undergo aminolysis with α, ω-diaminoalkane $NH_2(CH_2)qNH_2$ or polyamine $NH_2(CH_2CH_2NH)tH$.

In that case α,ω-diaminoalkane for reaction with hexafluoropropene oxide oligomer carboxylic acid or its alkyl ester, or the like must have 2 to 20 carbon atoms, preferably 8 to 12 carbon atoms. Below 2, i.e. when the chain length is too short, coagulation of magnetic particles cannnot be prevented, whereas above 20, i.e. when the chain length is too long, viscosity characteristics, etc. of the resulting magnetic fluid will be deteriorated. The reasons why p,q and r values are limited to such ranges as above in the general formulae of these three kinds of perfluoroether carboxylic acid amide compounds are because, when the p, q and r values are outside these ranges, the resulting magnetic fluids will have deteriorated characteristics, such as a decreased dispersibility, an increased viscosity, etc.

Since the dispersibility is not improved only with at least one of the compound ($B_1$), ($B_2$) and ($B_3$), at least one of the three kinds of perfluoroether carboxylic acid amide compounds (C) is used. These 3 kinds of perfluoroether carboxylic acid amide compounds (C) can be readily obtained by the method disclosed in Examples which follow.

The present magnetic fluid can be prepared by dispersing fine magnetic particles into perfluoropolyether base oil in the presence of at least one of the compounds ($B_1$), ($B_2$) and ($B_3$) and at least one of the perfluoroether carboxylic acid amide compounds (C), where about 10 to about 100 parts by weight, preferably about 20 to about 50 parts by weight of at least one of the compounds ($B_1$), ($B_2$) and ($B_3$)can be used per 100 parts by weight of fine magnetic particles and about 1 to about 150 parts by weight, preferably about 10 to about 80 parts by weight of perfluoroether carboxylic acid amide compounds (C) can be used per 100 parts by weight of perfluoropolyether base oil. The compounds ($B_1$), ($B_2$) or ($B_3$) and the amide compounds (C) can be added to the perfluoropolyether base oil at the same time or in any desired order.

Perfluoropolyether base oil represented by the following general formula:

$$F[CF(CF_3)CF_2O]mRf$$

where Rf is a perfluoroalkyl group, preferably a perfluoroalkyl group having 1 to 3 carbon atoms; and m is an integer of 1 or more, preferably 10 to 50 (on average), can be used in the present invention. Practically, commercially available perfluoropolyether base oil such as BARRIERTA series, trademark of a product made by NOK Kluber K.K., Japan, etc. can be used.

Dispersion treatment can be carried out by the ordinary method using a homogenizer, a ball mill, ultrasonic wave application, etc. A dispersion can be more readily propared when a fluorinated organic solvent such as Fluorinert FC-72 (trademark of a product made by Sumitomo-3M K.K., Japan) is used at the same time. In that case the organic solvent is distilled off after the preparation of the dispersion. Then, the dispersion is subjected to centrifuge to remove poorly dispersed fine particles therefrom, whereby a magnetic fluid can be obtained.

By using at least one of perfluoroether phosphoric acid, perfluoroether sulfonic acid, perfluoroether sulfuric acid ester or perfluoroether (poly)alkyleneether carboxylic acid or their salts and at least one of perfluoroether carboxylic acid amide compounds together in preparation of a fluorine-based magnetic fluid comprising fine magnetic particles as dispered in a perfluoropolyether base oil, a magnetic fluid of good dispersion can be obtained. The fluorine-based magnetic fluid thus obtained is effective for minimizing changes in degree of vacuum and torque, when used as a sealing material for a vacuum apparatus with a shaft, etc.

PREFERRED EMBODIMENTS OF THE INVENTION

The present invention will be described in detail below, referring to Examples and Comparative Examples.

EXAMPLE 1

A mixture consisting of the following Components (A) to (D) was subjected to a dispersion treatment under application of ultrasonic waves for 24 hours, whereby 39.0 g of fluorine-based magnetic fluid was obtained:

| | |
|---|---|
| (A) Coprecipitation process fine magnetite perticles (particle size: 90Å) | 4 g |
| ($B_1$) $F[CF(CF_3)CF_2O]nCF(CF_3)CH_2OPO(OH)_2$ (n: 15 on average) | 1 g |
| (C) $F[CF(CF_3)CF_2O]PCF(CF_3)CONH(CH_2)_{12}NH_2$ (p: 15 on average) | 5 g |
| (D) Perfluoropolyether base oil (BARRIERTA J100V, product of NOK Kluber K.K. Japan) | 30 g |

Component ($B_1$) was obtained by reaction of an alcohol prepared by reduction of methyl ester of hexafluoropropene oxide oligomer carboxylic acid with $P_2O_5$ at 80° C. for 5 hours, followed by extraction with a fluorine-based solvent (Fluorinert FC72, product of Sumitomo-3M K.K., Japan). Component (C) was obtained by reaction of methyl ester of hexafluoropropene oxide oligomer carboxylic acid with 1,12-diaminododecane (product of Tokyo Kasei K.K., Japan) at 120° C. for 5 hours, followed by extraction with a fluorine-based solvent (Fluorinert FC72) and by purification.

The fluorine-based magnetic fluid thus obtained was filled into a space formed between a shaft having 15 mm in diameter and a seal assembly of pole piece-permanent magnet-pole piece as inserted along the shaft to make a vacuum seal, and then the vacuum seal was placed in a vacuum seal-evaluating apparatus and put into a continuous operation under such conditions of 0.1 Torr and 1,000 rpm for 500 hours to determine the degree of vacuum and torque. It was found that there was no change in the degree of vacuum with the percent torque change being less than 1%.

EXAMPLE 2

In Example, the following compound was used in the same amount as Component (C) in place of the compound (C) of Example 1, and similar results were obtained:

| | |
|---|---|
| $F[CF(CF_3)CF_2O]pCF(CF_3)CONH(CH_2)_6NH_2$ | (p: 15 on average) |

EXAMPLE 3

In Example 1, the following compound was used in the same amount as Component ($B_1$) in place of the compound ($B_1$) of Example 1, and similar results were obtained:

| | |
|---|---|
| $F[CF(CF_3)CF_2O]pCF(CF_3)COO(CH_2)_8OPO(ONa)_2$ | (p: 15 on average) |

Component ($B_1$) used in Example 3 was obtained by adding 1, 6-hexanediol and a concentrated sulfuric acid catalyst to a carboxylic acid derived from methyl ester of hexafluoropropene oxide oligomer carboxylic acid, conducting reaction at 120° C. for 5 hours, then conducting reaction with $P_2O_5$ at 80° C. for 5 hours and neutralizing the reaction mixture with sodium hydroxide, followed by extraction with a fluorine-based solvent (Fluorinert FC72).

EXAMPLE 4

In Example 1, the following compound was used in the same amount as Component (C) in place of the compound (C) of Example 1 to prepare a fluorine-based magnetic fluid.

| | |
|---|---|
| $F[CF(CF_3)CF_2O]pCF(CF_3)CONH(CH_2CH_2NH)_5H$ | (p: 15 on average) |

The resulting magnetic fluid was determined for degree of vacuum and torque in the same manner as in Example 1. It was found that there was no change in the degree of vacuum with the percent torque change being not more than 5%.

Component (C) used in Example 4 was obtained by adding an equimolar amount of pentaethylenehexamine (product of Tokyo Kasei K.K., Japan) to methyl ester of hexafluoropropene oxide oligomer carboxylic acid and conducting reaction at 120° C. for 5 hours, followed by extraction with a fluorine-based solvent (Fluorinert FC72) and by purification.

EXAMPLE 5

In Example 4, the following compound was used in the same amount as Component (C) in place of the compound (C) of Example 4, and similar results were obtained:

| | |
|---|---|
| $F[CF(CF_3)CF_2O]pCF(CF_3)CONH(CH_2CH_2NH)_4H$ | (p: 15 on average) |

EXAMPLE 6

In Example 4, the following compound was used in the same amount as Component ($B_1$) in place of the compound ($B_1$) of Example 4 to prepare a fluorine-based magnetic fluid:

| |
|---|
| $\{F[CF(CF_3)CF_2O]_pCF(CF_3)CONH(CH_2)_6O\}tPO(ONa)u$ (p: 15 on average, t: 1.5 on average, u: 1.5 average) |

The resulting magnetic fluid was determined for degree of vacuum and torque in the same manner as in Example 1. It was found that there was no change in the degree of vacuum with the percent torque change being not more than 3%.

Component ($B_1$) used in Example 6 was obtained by reaction of methyl ester of hexafluoropropene oxide oligomer carboxylic acid with 6-hydroxyhexylamine at 70° C. for 3 hours to conduct amidation, followed by further reaction with $P_2O_5$ at 80° C. for 5 hours, neutralization with sodium hydroxide and extraction with a fluorine-based solvent (Fluorinert FC72).

EXAMPLE 7

In Example 1, the following compound was used in the same amount as Component (C) in place of the compound (C) of Example 1 to prepare a fluorine-based magnetic fluid:

| | |
|---|---|
| $F[CF(CF_3)CF_2O]pCF(CF_3)CONH(CH_2CH_2NH)_5COCF(CF_3)[OCF_2CF(CF_3)]pF$ | (p: 15 on average) |

The resulting magnetic fluid was determined for degree of vacuum and torque in the same manner as in Example 1. It was found that there was no change in the degree of vacuum with the percent torque change being not more than 5%.

Component (C) used in Example 7 was obtained by adding on one-half molar amount of pentaethylenehexamine (product of Tokyo Kasei K.K., Japan) to methyl ester of hexafluoropropene oxide oligomer carboxylic acid and conducting reaction at 120° C. for 5 hours, followed by extraction with a fluorine-based solvent (Fluorinert FC72) and by purification.

EXAMPLE 8

In Example 7, the following compound was used in the same amount as Component (C) in place of the compound (C) of Example 7, and similar results were obtained:

| | |
|---|---|
| $F[CF(CF_3)CF_2O]pCF(CF_3)CONH(CH_2CH_2NH)_4COCF(CF_3)[OCF_2CF(CF_3)]pF$ | (p: 15 on average) |

EXAMPLE 9

In Example 7, the same compound as used in Example 7 except that n was 20 on average was used in the same amount as Component ($B_1$) in place of the compound ($B_1$) of Example 7, and similar results were obtained.

COMPARATIVE EXAMPLE 1

In Example 1, Component (C) was not used at all. Dispersibility of fine magnetic particles was so poor that no magnetic fluid was obtained.

COMPARATIVE EXAMPLE 2

In Example 3, Component (C) was not used at all. A magnetic fluid was obtained, but the degree of vacuum was lowered to 10 Torr with the percent torque change being not less than 10%.

EXAMPLE 10

A mixture consisting of the following Components (A) to (D) was subjected to a dispersion treatment under application of ultrasonic waves for 24 hours, whereby 39.9 g of fluorine-based magnetic fluid was obtained:

| | |
|---|---|
| (A) Coprecipitation process fine magnetic perticles (particle size: 90Å) | 4 g |
| ($B_2$) $F[CF(CF_3)CF_2O]nCF(CF_3)COO(CH_2)_2SO_3H$ (n: 8 on average) | 1 g |
| (C) $F[CF(CF_3)CF_2O]PCF(CF_3)CONH(CH_2)_{12}NH_2$ (p: 15 on average) | 5 g |
| (D) Perfluoropolyether base oil (BARRIERTA J100V) | 30 g |

Component ($B_2$) was obtained by refluxing one part by mole of hexafluoropropene oxide oligomer carboxylic acid and 1.5 parts by mole of $HOCH_2CH_2SO_3H$ (obtained by reaction of vinyl acetate with fuming sulfuric acid, followed by hydrolysis) in the presence of an acid or alkali for 24 hours.

The resulting fluorine-based magnetic fluid was determined for degree of vacuum and torque in the same manner as in Example 1, where vacuum was changed to 0.01 Torr. It was found that there was no change in the degree of vacuum with the percent torque change being not more than 1%.

EXAMPLE 11

In Example 10, the following compound was used in the same amount as Component (C) in place of the compound (C) of Example 10, and similar results were obtained:

| | |
|---|---|
| $F[CF(CF_3)CF_2O]pCF(CF_3)CONH(CH_2)_8NH_2$ | (p: 15 on average) |

EXAMPLE 12

In Example 10, the same compound except that n was 15 on average was used in the same amount as Component ($B_2$) in place of the compound ($B_2$) of Example 10, and similar results were obtained.

EXAMPLE 13

In Example 10, the following compound was used in the same amount as Component (C) in place of the compound (C) of Example 10 to prepare a fluorine-based magnetic fluid:

| | |
|---|---|
| $F[CF(CF_3)CF_2O]pCF(CF_3)CONH(CH_2CH_2NH)_5H$ | (p: 15 on average) |

The resulting magnetic fluid was determined for degree of vacuum and torque in the same manner as in Example 10. It was found that there was no change in the degree of vacuum with the percent torque change being not more than 5%.

EXAMPLE 14

In Example 13, the following compound was used in the same amount as Component (C) in place of the compound (C) of Example 13, and the similar results were obtained:

| | |
|---|---|
| $F[CF(CF_3)CF_2O]pCF(CF_3)CONH(CH_2CH_2NH)_4H$ | (p: 15 on average) |

EXAMPLE 15

In Example 13, the same compound except that n was 15 on average was used in the same amount as Component ($B_2$) in place of the compound ($B_2$) of Example 13, and similar results were obtained.

EXAMPLE 16

In Example 10, the following compound was used in the same amount as Component (C) in place of the compound (C) of Example 10 to prepare a fluorine-based magnetic fluid:

| | |
|---|---|
| $F[CF(CF_3)CF_2O]pCF(CF_3)CONH(CH_2CH_2NH)_5COCF(CF_3)[OCF_2CF(CF_3)]pF$ | (p: 15 on average) |

The resulting magnetic fluid was determined for degree of vacuum and torque in the same manner as in Example 10. It was found that there was no change in the degree of vacuum with the percent torque change being not more than 5%.

EXAMPLE 17

In Example 16, the following compound was used in the same amount as Component (C) in place of the compound (C) of Example 16, and similar results were obtained:

| | |
|---|---|
| $F[CF(CF_3)CF_2O]pCF(CF_3)CONH(CH_2CH_2NH)_4COCF(CF_3)[OCF_2CF(CF_3)]pF$ | (p: 15 on average) |

EXAMPLE 18

In Example 16, the same compound except that n was 15 on average was used in the same amount as Compound ($B_2$) in place of the compound ($B_2$) of Example 16, and similar results were obtained.

EXAMPLE 19

In Example 10, 2.5 g of the following compound was used as Component ($B_2$) in place of the compound ($B_2$) of Example 10, and similar results were obtained:

| | |
|---|---|
| $F[CF(CF_3)CF_2O]nCF(CF_3)CONH(CH_2)_2SO_3H$ | (n: 15 on average) |

EXAMPLE 20

In Example 10, 5 g of the following compound was used as Component ($B_2$) in place of the compound ($B_2$) of Example 10, and similar results were obtained:

| | |
|---|---|
| $F[CF(CF_3)CF_2O]nCF(CF_3)CONH(CH_2)_{10}SO_3Na$ | (n: 15 on average) |

EXAMPLE 21

In Example 10, the following compound was used in the same amount as Component ($B_2$) in place of the compound ($B_2$) of Example 10 to prepare a fluorine-based magnetic fluid:

| | |
|---|---|
| $F[CF(CF_3)CF_2O]nCF(CF_3)CH_2OSO_3Na$ | (n: 8 on average) |

The resulting magnetic fluid was determined for degree of vacuum and torque in the same manner as in Example 10, except that the number of revolution was changed to 500 rpm and the continuous operation time to 300 hours. It was found that there was no change in the degree of vacuum with the percent torque change being not more than 3%.

EXAMPLE 22

In Example 21, 2.5 g of the following compound was used as Component ($B_2$) in place of the compound ($B_2$) of Example 21, and similar results were obtained:

| | |
|---|---|
| $F[CF(CF_3)CF_2O]nCF(CF_3)COO(CH_2)_{18}OSO_3$ 1/2 Ca | (n: 8 on average) |

COMPARATIVE EXAMPLE 3

In Example 10, Component (C) was not used at all. Dispersibility of fine magnetic particles was so poor that no magnetic fluid was obtained.

COMPARATIVE EXAMPLE 4

In Example 12, Component (C) was not used at all. A magnetic fluid was obtained, but the degree of vacuum was lowered with the percent torque change being not less than 10%.

EXAMPLE 23

A mixture consisting of the following Components (A) to (D) was subjected to a dispersion treatment under application of ultrasonic waves for 24 hours, whereby 39.6 g of fluorine-based magnetic fluid was obtained:

| | |
|---|---|
| (A) Copresipitation process fine magnetite particles (particle size: 90Å) | 4 g |
| ($B_3$) $F[CF(CF_3)CF_2C]nCF(CF_3)COO(CH_2CH_2O)sCH_2COONa$ (n: 15 on average, s: 6.8 on average) | 1 g |
| (C) $F[CF(CF_3)CF_2O]pCF(CF_3)CONH(CH_2)_{12}NH_2$ (p: 15 on average) | 5 g |
| (D) Perfluoropolyether base oil (BARRIERTA J100V) | 30 g |

Component ($B_3$) was obtained by transesterification between methyl ester of hexafluoropropene oxide oligomer carboxylic acid and polyethylene glycol (#300, product of Kanto Kagaku K.K., Japan) at 80° C. for 5 hours, using a sodium methoxide catalyst, followed by action of sodium monochloro-acetate and sodium hydroxide, and extraction with a fluorine-based solvent (Fluorinert FC72).

The resulting fluorine-based magnefic fluid was determined for degree of vacuum and torque in the same manner as in Example 10, except that the continuous operation time was changed to 700 hours. It was found that there was no change in the vaccum degree with the percent torque change being not more than 1%.

EXAMPLE 24

In Example 23, the following compound was used in the same amount as Component (C) in place of the compound (C) of Example 23 and similar results were obtained:

| | |
|---|---|
| $F[CF(CF_3)CF_2O]pCF(CF_3)CONH(CH_2)_8NH_2$ | (p: 15 on average) |

EXAMPLE 25

In Example 23, compound ($B_3$) obtained with polyethylene glycol (#200, product of Kanto Kagaku K.K., Japan) in place of the polyethylene glycol (#300) was used in the same amount as Component ($B_3$) in place of the compound ($B_3$) of Example 23, and similar results were obtained.

EXAMPLE 26

In Example 23, the following compound was used in the same amount as Component (C) in place of the compound (C) of Example 23 to prepare a fluorine-based magnetic fluid:

| | |
|---|---|
| $F[CF(CF_3)CF_2O]pCF(CF_3)CONH(CH_2CH_2NH)_5H$ | (p: 15 on average) |

The resulting magnetic fluid was determined for degree of vacuum and torque in the same manner as in Example 10, except that the continuous operation time was changed to 700 hours. It was found that there was no change in the degree of vacuum with the percent torque change being not more than 5%.

EXAMPLE 27

In Example 23, the following compound was used in the same amount as Component (C) in place of the compound (C) of Example 23 to prepare a fluorine-based magnetic fluid:

| | |
|---|---|
| $F[CF(CF_3)CF_2O]pCF(CF_3)CONH(CH_2CH_2NH)_5COCF(CF_3)[OCF_2CF(CF_3)]pF$ | (p: 15 on average) |

The resulting magnetic fluid was determined for degree of vacuum and torque in the same manner as in Example 10, except that the continuous operation time was changed to 700 hours. It was found that there was no change in the degree of vacuum with the percent torque change being not more than 5%.

EXAMPLE 28

In Example 23, the following compound was used in the same amount as Component ($B_3$) in place of the compound ($B_3$) of Example 23, whereby 39.8 g of fluorine-based magnetic fluid was obtained:

| | |
|---|---|
| $F[CF(CF_3)CF_2O]nCF(CF_3)CH_2O(CH_2CH_2O)sCH_2COONa$ | (n: 15 on average, s: 4.5 on average) |

Component ($B_3$) was obtained by reducing free carboxylic acid derived from methyl ester of hexafluoropropene oxide oligomer carboxylic acid with $LiAlH_4$, allowing the resulting alcohol to react with polyethylene glycol (#200) in the presence of concentrated sulfuric acid at 120° C. for 5 hours, and allowing sodium monochloroacetate and sodium hydroxide to act on the reaction product, followed by extraction with a fluorine-based solvent (Fluorinert FC72) and by purification.

The resulting fluorine-based magnetic fluid was determined for degree of vacuum and torque in the same manner as in Example 10, except that the number of revolution was changed to 500 rpm. It was found that there was no change in the degree of vacuum with the percent torque change being not more than 1%.

COMPARATIVE EXAMPLE 5

In Example 23, Component (C) was not used at all. Dispersibility of fine magnetic particles was so poor that no magnetic fluid was obtained.

COMPARATIVE EXAMPLE 6

In Example 26, Component (C) was not used at all. A magnetic fluid was obtained, but the degree of vacuum was lowered with the percent torque change being not less than 10%.

What is claimed is:

1. A fluorine-based magnetic fluid, which comprised (A) fine magnetic particles as dispersed in (D) a perfluoropolyether base oil represented by the following general formula:

$$F[CF(CF_3)CF_2O]mRf$$

where Rf is a perfluoroalkyl group and m is an integer of 1 or more, by means of ($B_1$) a perfluoroether phosphoric acid or its salt represented by the following general formula:

$$\{F[CF(CF_3)CF_2O]nCF(CF_3)\ (Y)v(R)wO\}tPO(OM)u$$

where R is a divalent organic group; Y is a COO group or CONH group; M is a hydrogen atom, an alkali metal, an alkaline earth metal or an ammonium group, n is an integer of 1 to 100; t is 1 or 2; u is 3-t; and v and w each are 0 or 1, and ($C_1$) a perfluoroether carboxylic acid amide compound represented by the following general formula:

$$F[CF(CF_3)CF_2O]pCF(CF_3)CONH(CH_2)qNH_2$$

where p is an integer of 1 or more and q is an integer of 2 to 20.

2. A fluorine-based magnetic fluid according to claim 1, wherein the fine magnetic particles are fine ferrite particles.

3. A fluorine-based magnetic fluid according to claim 1, wherein about 10 to about 100 parts by weight of the perfluoroether phosphoric acid or its salt is used per 100 parts by weight of the fine magnetic particles.

4. A fluorine-based magnetic fluid according to claim 1, wherein about 1 to about 150 parts by weight of the perfluoroether carboxylic acid amide compound is used per 100 parts by weight of the perfluoropolyether base oil.

5. A fluorine-based magnetic fluid, which comprises (A) fine magnetic particles as dispersed in (D) a perfluoropolyether base oil represented by the following general formula:

$$F[CF(CF_3)CF_2O]mRf$$

where Rf is a perfluoroalkyl group and m is an integer of 1 or more, by means of ($B_1$) a perfluoroether phosphoric acid or its salt represented by the following general formula:

$$\{F[CF(CF_3)CF_2O]nCF(CF_3)\ (Y)v(R)wO\}tPO(OM)u$$

where R is a divalent organic group; Y is a COO group or CONH group; M is a hydrogen atom, an alkali metal, an alkaline earth metal or an ammonium group; n is an integer of 1 to 100; t is 1 or 2; u is 3-t; and v and w each are 0 or 1, and ($C_2$) a perfluoroether carboxylic acid amide compound represented by the following general formula:

$$F[CF(CF_3)CF_2O]pCF(CF_3)CONH(CH_2CH_2NH)rH$$

where p is an integer of 1 or more and r is an integer of 1 to 6.

6. A fluorine-based magnetic fluid accoding to claim 5, wherein the fine magnetic particles are fine ferrite particles.

7. A fluorine-based magnetic fluid according to claim 5, wherein about 10 to about 100 parts by weight of the perfluoroether phosphoric acid or its salt is used per 100 parts by weight of the fine magnetic particles.

8. A fluorine-based magnetic fluid according to claim 5, wherein about 1 to about 150 parts by weight of the perfluoroether carboxylic acid amide compound is used per 100 parts by weight of the perfluoropolyether base oil.

9. A fluorine-based magnetic fluid, which comprises (A) fine magnetic particles as dispersed in (D) a perfluoropolyether base oil represented by the following general formula:

$$F[CF(CF_3)CF_2O]mRf$$

where Rf is a perfluoroalkyl group and m is an integer of 1 or more, by means of ($B_1$) a perfluoroether phosphoric acid or its salt represented by the following general formula:

$$\{F[CF(CF_3)CF_2O]nCF(CF_3)\ (Y)v(R)wO\}tPO(OM)u$$

where R is a divalent organic group; Y is a COO group or CONH group; M is a hydrogen atom, an alkali metal, an alkaline earth metal or an ammonium group; n is an integer of 1 to 100; t is 1 or 2; u is 3-t; and v and w each are 0 or 1, and ($C_3$) a perfluoroether biscarboxylic acid amide compound represented by the following general formula:

$$F[CF(CF_3)CF_2O]pCF(CF_3)CONH(CH_2CH_2NH)rCOCF(CF_3)[OCF_2CF(CF_3)]pF$$

where p is an integer of 1 or more; and r is an integer of 1 to 6.

10. A fluorine-based magnetic fluid according to claim 9, wherein the fine magnetic particles are fine ferrite particles.

11. A fluorine-based magnetic fluid according to claim 9, wherein about 10 to about 100 parts by weight of the perfluoroether phosphoric acid or its salt is used per 100 parts by weight of the fine magnetic particles.

12. A fluorine-based magnetic fluid according to claim 9, wherein about 1 to about 150 parts by weight of the perfluoroether biscarboxylic acid amide compound is used per 100 parts by weight of the perfluoropolyether base oil.

13. A fluorine-based magnetic fluid, which comprises (A) fine magnetic particles as dispersed in (D) a perfluoropolyether base oil represented by the following general formula:

$F[CF(CF_3)CF_2O]mRf$ where Rf is a perfluoroalkyl group and m is an integer of 1 or more, by means of ($B_2$) a perfluoroether sulfonic acid or its salt represented by the following general formula:

$F[CF(CF_3)CF_2O]nCF(CF_3)YRSO_3M$ where R is a divalent organic group; M is a hydrogen atom, an alkali metal, an alkaline earth metal or an ammonium group; Y is a COO group or CONH group; and n is an integer of 1 to 100, or a perfluoroether sulfuric acid ester or its salt represented by the following formula:

$F[CF(CF_3)CF_2O]nCF(CF_3)\ (Y)mR'OSO_3M$ where R' is a divalent organic group; M, Y and n have the same meanings as defined above; and m is 0 or 1, and ($C_1$) a perfluoroether carboxylic acid amide compound represented by the following general formula:

$F[CF(CF_3)\ CF_2O]pCF(CF_3)CONH(CH_2)qNH_2$ where p is an integer of 1 or more and q is an integer of 2 to 20.

14. A fluorine-based magnetic fluid according to claim 13, wherein the fine magnetic particles are fine ferrite particles.

15. A fluorine-based magnetic fluid according to claim 13, wherein about 10 to about 100 parts by weight of the perfluoroether sulfonic acid or its salt or the perfluoroether sulfuric acid ester or its salt is used per 100 parts by weight of the fine magnetic particles.

16. A fluorine-based magnetic fluid according to claim 13, wherein about 1 to about 150 parts by weight of the perfluoroether carboxylic acid amide compound is used per 100 parts by weight of the perfluoropolyether base oil.

17. A fluorine-based magnetic fluid, which comprises (A) fine magnetic particles as dispersed in (D) a perfluoropolyether base oil represented by the following general formula:

$F[CF(CF_3)CF_2O]mRf$ where Rf is a perfluoroalkyl group and m is an integer of 1 or more, by means of ($B_2$) a perfluoroether sulfonic acid or its salt represented by the following general formula:

$F[CF(CF_3)CF_2O]nCF(CF_3)YRSO_3M$ where R is a divalent organic group; M is a hydrogen atom, an alkali metal, an alkaline earth metal or an ammonium group; Y is a COO group or CONH group; and n is an integer of 1 to 100, or a perfluoroether sulfuric acid ester or its salt represented by the following general formula:

$F[CF(CF_3)CF_2O]nCF(CF_3)\ (Y)mR'OSO_3M$ where R' is a divalent organic group; M, Y and n have the same meanings as defined above; m is an integer of 0 or 1, and (C) a perfluoroether carboxylic acid amide compound represented by the following general formula:

$F[CF\ (CF_3)CF_2O]pCF(CF_3)CONH(CH_2CH_2NH)rH$ where p is an integer of 1 or more and r is an integer of 1 to 6.

18. A fluorine-based magnetic fluid according to claim 17, wherein the fine magnetic particles are fine ferrite particles.

19. A fluorine-based magnetic fluid according to claim 17, whrein about 10 to about 100 parts by weight of the perfluoroether sulfonic acid or its salt, or the perfluoroether sulfuric acid ester or its salt is used per 100 parts by weight of the fine magnetic particles.

20. A fluorine-based magnetic fluid according to claim 17, wherein about 1 to about 150 parts by weight of the parfluoroether carboxylic acid amide compound is used per 100 parts by weight of the perfluoropolyether base oil.

21. A fluorine-based magnetic fluid, which comprises (A) fine magnetic particles as dispersed in (D) a perfluoropolyether base oil represented by the following general formula:

$F[CF(CF_3)CF_2O]mRf$ where Rf is a perfluoroalkyl group and m is an integer of 1 or more, by means of ($B_2$) a perfluoroether sulfonic acid or its salt represented by the following general formula:

$F[CF(CF_3)CF_2O]nCF(CF_3)YRSO_3M$ where R is a divalent organic aroup; M is a hydrogen atom, an alkali metal, an alkaline earth metal or an ammonium group; Y is a COO group or CONH group; an n is an integer of 1 to 100, or a perfluoroether sulfuric acid ester or its salt represented by the following general formula:

$F[CF(CF_3)CF_2O]nCF(CF_3)\ (Y)mR'OSO_3M$ where R' is a divalent organic group; M, Y and n have the same meaning as defined above; and m is 0 or 1, and ($C_3$) a perfluoroether biscarboxylic acid amide compound represented by the following general formula:

$F[CF(CF_3)CF_2O]pCF(CF_3)CONH(CH_2CH_2NH)rCOCF(CF_3)[OCF_2CF(CF_3)]pF$ where p is an integer of 1 or more and r is an integer of 1 to 6.

22. A fluorine-based magnetic fluid according to claim 21, wherein the fine magnetic particles are fine ferrite particles.

23. A fluorine-based magnetic fluid according to claim 21, wherein about 10 to about 100 parts by weight of the perfluoroether sulfonic acid or its salt, or the perfluoroether sulfuric acid ester or its salt is used per 100 parts by weight of the fine magnetic particles.

24. A fluorine-based magnetic fluid according to claim 21, wherein about 1 to about 150 parts by weight of the perfluoroether biscarboxylic acid amide compound is used per 100 parts by weight of the perfluoropolyether base oil.

25. A fluorine-based magnetic fluid, which comprises (A) fine magnetic particles as dispersed in (D) a perfluoropolyether base oil represented by the following general formula:

$F[CF(CF_3)CF_2O]mRf$ where Rf is a perfluoroalkyl group and m is an integer of 1 or more, by means of ($B_3$) a perfluoroether (poly) alkyleneether carboxylic acid or its salt represented by the following general formula:

$F[CF(CF_3)CF_2O]nCF(CF_3)X(RO)sCH_2COOM$ where R is a lower alkylene group; M is a hydrogen atom, an alkali metal, an alkaline earth metal or an ammonium group; X is a COO group or $CH_2O$ group; and n and s each are an integer of 1 to 100, and ($C_1$) a perfluoroether carboxylic acid amide compound represented by the following general formula:

$F[CF(CF_3)CF_2O]pCF(CF_3)CONH(CH_2)qNH_2$ where p is an integer of 1 or more and q is an integer of 2 to 20.

26. A fluorine-based magnetic fluid according to claim 25, whrein the fine magnetic particles are fine ferrite particles.

27. A fluorine-based magnetic fluid according to claim 25, wherein about 10 to about 100 parts by weight of the perfluoroether (poly)alkyleneether carboxylic acid or its salt is used per 100 parts by weight of the fine magnetic particles.

28. A fluorine-based magnetic fluid according to claim 25, wherein about 1 to about 150 parts by weight of the perfluoroether carboxylic acid amide compound is used per 100 parts by weight of the perfluoropolyether base oil.

29. A fluorine-based magnetic fluid, which comprises (A) fine magnetic particles as dispersed in (D) a perfluoropolyether base oil represented by the following general formula:

$F[CF(CF_3)CF_2O]mRf$ where Rf is a perfluoroalkyl group and m is an integer of 1 or more, by means of ($B_3$) a perfluoroether (poly) alkylene.ether carboxylic acid or its salt represented by the following general formula:

$F[CF(CF_3)CF_2O]nCF(CF_3)X(RO)sCH_2COOM$ where R is a lower alkylene group; M is a hydrogen atom, an alkali metal, an alkaline earth metal or an ammonium group; X is a COO group or $CH_2O$ group; and n and s each are an integer of 1 to 100, and ($C_2$) a perfluoroether carboxylic acid amide compound represented by the following general formula:

$F[CF(CF_3)CF_2O]pCF(CF_3)CONH(CH_2CH_2NH)rH$ where p is an integer of 1 or more and r is an integer of 1 to 6.

30. A fluorine-based magnetic fluid according to claim 29, wherein the fine magnetic particles are fine ferrite particles.

31. A fluorine-based magnetic fluid according to claim 29, wherein about 10 to about 100 parts by weight of the perfluoroether (poly)alkyleneether carboxylic acid or its salt is used per 100 parts by weight of the fine magnetic particles.

32. A fluorine-based magnetic fluid according to claim 29, wherein about 1 to about 150 parts by weight of the perfluoroether carboxylic acid amide compound is used per 100 parts by weight of the perfluoropolyether base oil.

33. A fluorine-based magnetic fluid, which comprises (A) fine magnetic particles as dispersed in (D) a perfluoropolyether base oil represented by the following general formula:

$F[CF(CF_3)CF_2O]mRf$ where Rf is a perfluoroalkyl group and m is an integer of 1 or more, by means of ($B_3$) a perfluoroether (poly)alkylene ether carboxylic acid or its salt represented by the following general formula:

$F[CF(CF_3)CF_2O]nCF(CF_3)X(RO)sCH_2COOM$ where R is a lower alkylene group; M is a hydrogen atom, an alkyl metal, an alkaline earth metal or an ammonium group; X is a COO group or $CH_2O$ group; and n and s each are an integer of 1 to 100, and ($C_3$) a perfluoroether biscarboxylic acid amide compound represented by the following general formula:

$F[CF(CF_3)CF_2O]pCF(CF_3)CONH(CH_2CH_2NH)rCOCF(CF_3)[OCF_2CF(CF_3)]pF$ where p is an integer of 1 or more and r is an integer of 1 to 6.

34. A fluorine-based magnetic fluid according to claim 33, wherein the fine particles are fine ferrite particles.

35. A fluorine-based magnetic fluid according to claim 33, wherein about 10 to about 100 parts by weight of the perfluoroether (poly) alkyleneether carboxylic acid or its salt is used per 100 parts by weight of the fine magnetic particles.

36. A fluorine-based magnetic fluid according to claim 33, wherein about 1 to about 150 parts by weight of the perfluoroether biscarboxylic acid amide compound is used per 100 parts by weight of the perfluoropolyether base oil.

* * * * *